United States Patent [19]

Klein

[11] 3,958,626

[45] May 25, 1976

[54] REGENERATOR MATRIX STRUCTURE

[75] Inventor: Lee F. Klein, North Tonawanda, N.Y.

[73] Assignee: General Motors Corporation, Detroit, Mich.

[22] Filed: Feb. 21, 1975

[21] Appl. No.: 551,604

[52] U.S. Cl. ..... 165/8; 165/10; 29/191.4; 29/193.5

[51] Int. Cl.[2] ..... F28D 19/00

[58] Field of Search ..... 165/8, 9, 10; 29/191.4, 29/191.6, 191, 193.5

[56] References Cited

UNITED STATES PATENTS

| | | | |
|---|---|---|---|
| 3,276,515 | 10/1966 | Whitfield | 165/10 |
| 3,532,157 | 10/1970 | Hubble | 165/8 |
| 3,534,807 | 10/1970 | Bracken, Jr. | 165/9 |

*Primary Examiner*—Albert W. Davis, Jr.
*Attorney, Agent, or Firm*—Arthur N. Krein

[57] ABSTRACT

A matrix structure for a rotary regenerator includes a pair of spiral wound strips with each turn of one strip disposed between adjacent turns of the other strip with the strips abutting face to face and fixed together, as by brazing, into a rigid, elastic structure, the one strip being formed with corrugations trending generally axially of the matrix and with substantial depth radially of the matrix to separate radially the turns of the other strip and to define fluid flow passages through the corrugations, the corrugations including a repeatable pattern of a first plurality of corrugations having equally curved ridges and hollows of a predetermined amplitude and a second set of corrugations including at least one ridge and one hollow of a reduced amplitude as compared to the amplitude of the first plurality of corrugations.

2 Claims, 4 Drawing Figures

REGENERATOR MATRIX STRUCTURE

This invention relates to a rotary regenerator disk and, in particular, to a main heat transfer matrix core structure for such a regenerator disk.

Rotary regenerators, particularly of the axial flow type as used in gas turbine engines, utilize heat transfer means in the form of a porous metal disk matrix which is rotated so that each element thereof passes successively through two aeriform fluid flow paths, absorbing heat from a hotter fluid and releasing it to a cooler fluid in these flow paths.

Metal matrices ordinarily are made up of crimped or corrugated metal sheets spirally wound into a disk and then brazed or otherwise bonded together so as to provide a rigid cellular or porous structure. This rigid cellular or porous structure is normally enclosed at the outer peripheral edges thereof by outer sealing rings or by an outer ring which provides a solid rim around the periphery of the matrix.

The conventional inner core structure or main heat transfer body of such an axial flow regenerator matrix disk involves alternating flat and corrugated strips or alternating corrugated strips which are spirally wound to form the main heat transfer body of the matrix. One example of such an alternating flat strip and corrugated strip structure is illustrated in U.S. Pat. No. 3,276,515 for "Gas Turbine Regenerator" issued Oct. 4, 1966 to James H. Whitfield. An example of a matrix structure using alternating corrugated strips is illustrated in U.S. Pat. No. 3,532,157 entitled "Regenerator Disk" issued Oct. 6, 1970 to William S. Hubble.

The process of forming such a matrix structure composed of a pair of strips spirally wound around a central core is such that compressive loads are inherent in the physical make-up of the matrix structure, with each successive wrap of the strips adding to the load of those spiral wraps radially inward thereof toward the core and, for example, with a matrix diameter of 25 inches, this compressive load on the radially innermost wraps can be significant. Thus, both from the standpoint of manufacturing and service, such loading can produce undesirable results, such as fracturing, faults, voids and separations of the strips forming these wraps.

Also in regenerators of the type to which this invention is particularly applicable, as used in gas turbine engines, the major portion of the disk is heated to relatively high temperatures of the order of up to 1450°F or higher whereas the rim or radially outermost portion of the matrix disk is contacted around the perimeter by the relatively cool air and thus is at substantially lower temperature. In addition, the regenerators are also cycled between cool and hot conditions when the engine is started and stopped. Other factors may cause temperature gradients but, in general, whatever the reason for the differences in temperature between different radial zones of the matrix, the result is differential expansion with attendant over-stressing and yielding of the parts and resulting cracking.

Also, service temperature variations within which the disk operates result in bowing away of the disk structure toward the hot (inboard) area, that is, it causes the disk to appear somewhat saucer shaped. This saucering then presents sealing problems, and dimensional clearance problems among other problems within the regenerator. To restrict this deformation of the unit would be of great value, not only from the point of performance of the regenerator, but also from the standpoint of durability of the regenerator structure.

It is therefore the primary object of this invention to provide a regenerator matrix structure wherein the main heat transfer matrix core of such a regenerator will have predetermined voids therein which will permit deformation of the strips, forming the structure, under both radial as well as circumferential stress.

Another object of this invention is to provide a center matrix strip configuration which in company with a spacer or shim in a spiral wound regenerator matrix structure permits the unit to withstand a variety of thermal loads and at the same time to minimize thermal growth and individual cell deformation or rupture within the matrix core.

These and other objects of the invention are obtained by a rotary regenerator matrix structure fabricated from a pair of spiral wound strips with each turn of one of the strips disposed between adjacent turns of the other strip, with the strips abutting face to face and fixed together into a rigid elastic structure, one of the strips being a deeply corrugated strip having alternating ridges and hollows with at least an adjacent ridge and a hollow at predetermined spaced intervals in the corrugations having a predetermined depth radially of the matrix less than the next adjacent series of ridges and hollows of the corrugated strip.

For a better understanding of the invention, as well as other objects and further features thereof, reference is had to the following detailed description of the invention to be read in connection with the accompanying drawings, wherein.

Figure 1:
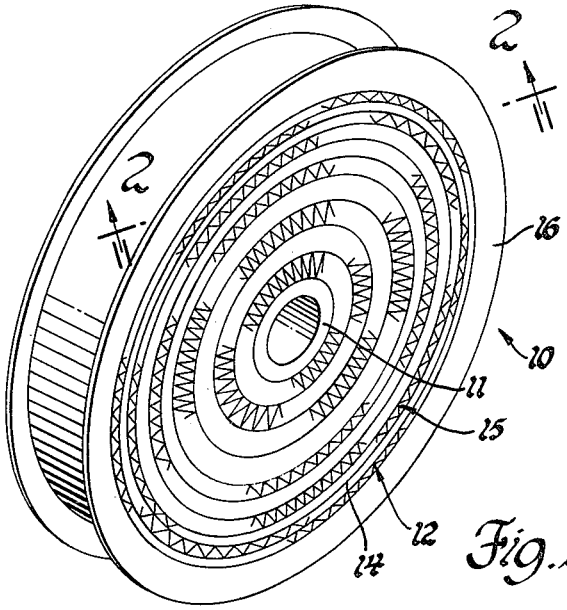
FIG. 1 is an axonometric view of the axial flow regenerator matrix disk.

Referring now to the drawings, there is shown in FIG. 1 an axial flow regenerator matrix structure 10. Since such a regenerator matrix structure may be over 2 feet in diameter with a thickness of only about 3 inches, it will be apparent that the illustration thereof in FIG. 1 is exaggerated to show the separate elements, to be described, of this structure.

Th matrix structure 10 includes a cylindrical hub 11 which may include means, not shown, for connecting the hub to a matrix driving shaft, such as disclosed in U.S. Pat. No. 3,476,173 for "Rotary Regenerator Matrix Mount and Drive" issued Nov. 4, 1969 to Joseph W. Bracken, Jr., and William S. Hubble. The matrix further includes a cylindrical or disk shaped main body or inner core 12 of heat transfer material which, in accordance with the invention, is formed by a flat shim strip 14 and a corrugated strip 15, to be described in detail hereinafter, spirally wrapped around the hub so as to define passages extending generally axially of the matrix through the corrugations. The matrix 10 may also include an outer rigid rim 16, herein shown as a one-piece steel ring with which the rim seals, not shown, of the regenerator cooperate, the rim extending around the periphery of the inner core 12 of the matrix.

Figure 2:
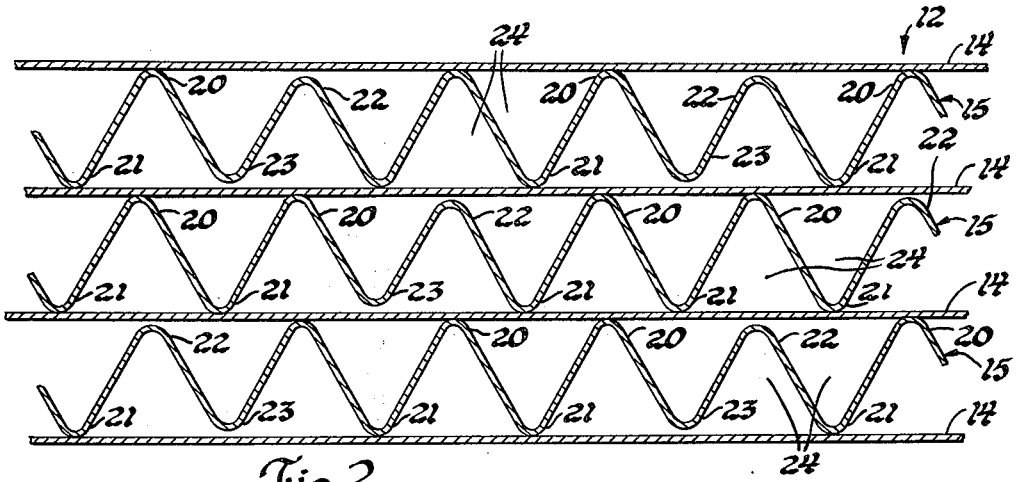
FIG. 2 is a detailed sectional view, on an enlarged and exaggerated scale, taken on a plane indicated by the line 2-2 in FIG. 1, with the strips shown in the as assembled condition with no load applied against the matrix.
Figure 4:
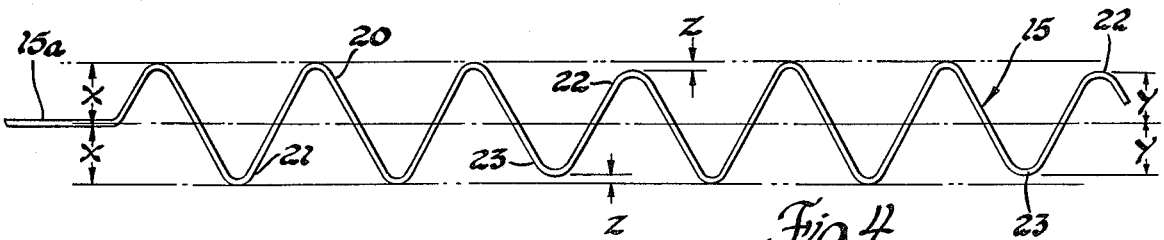

Now, in accordance with the invention, the corrugated strip 15, as best seen in FIG. 2, is provided with a continuous repeating pattern of deep corrugations trending axially of the matrix, providing straight, parallel ridges and hollows, the depth of selected corrugations in a set of at least one adjacent ridge and one hollow at predetermined spaced intervals along the length of the strip 15 being slightly less than the depth of the remaining corrugations in the next adjacent strip of corrugations. That is, the corrugated strip 15 which, as shown in FIG. 4, may be formed from a flat strip 15*a* of stainless steel approximately 0.002 inch thick as, for example, by being fed between the bight of a pair of forming rolls, not shown, of the desired configuration, has the ridges and hollows defining the corrugations formed thereon to extend from opposite sides of the original plane of the flat strip 15*a* from which the corrugated strip is formed. The completed corrugated strip 15 thus has somewhat the visual appearance of a sine wave.

Thus, the corrugated strip 15, as formed, preferably has a repeatable pattern of corrugations including in series a set of corrugations defined by the ridges 20 and hollows 21 of uniform depth, as seen in FIG. 4, each ridge 20 and hollow 21 having an amplitude of X above and below, respectively, of the original plane of the flat strip 15a, and each such set of corrugations formed by the ridges 20 and hollows 21 being separated from the next adjacent set of corresponding corrugations by at least one corrugation of reduced depth defined by a ridge 22 and hollow 23 having an amplitude less than that of the ridges 20 and hollows 21. That is, the ridge 22 and hollow 23 have an amplitude of Y above and below, respectively, of the original plane of the strip 15*a*, with the amplitude Y being a distance Z less than that of X. In the section of the matrix core structure shown in FIGS. 2, 3 and 4, the width of the corrugations on the corrugated strip 15 are substantially uniform.

Thus, the corrugated strip 15 when assembled in spiral wrapped configuration with the strip 14 has a plurality of corrugations with a nominal depth of 2X and at spaced intervals, corrugations of a reduced depth that is equal to 2X–2Z or simply 2Y. The dimension Z should be relatively small but, as will become apparent, should be sufficiently large enough to prevent the ridges 22 and hollows 23 from being fixed to the strip 14 during the fabrication and then brazing together of the elements of the matrix structure.

As used herein, the term "depth" refers to the radial dimension of the corrugations transverse to the general plane of the strip in the assembled matrix structure and the term "width" refers to the distance from the center of one ridge of the corrugations to the center of the next adjacent ridge in the direction circumferentially of the matrix.

In the as assembled, spiral wrapped configuration of the strip 14 with corrugated strip 15, and with no load, either radial or circumferential, thereon, as shown in FIG. 2, the corrugated strip 15 would maintain spaced apart separation of the turns of the strip 14 to define the fluid flow passages 24. Also with no load thereon, the strip 14 is substantially flat so as to engage and to be fixed, as by brazing, to the ridges 20 and hollows 21 of the corrugated strip 15 to maintain approximately constant spacing between adjacent turns of the strip 14. In this condition, the adjacent wraps of the strip 14 would not engage and therefore would not be fixed during the brazing process to the adjacent undersized corrugations defined by the ridges 22 and hollows 23, as clearly seen in FIG. 2, because of the reduced depth of these corrugations as compared to the remaining corrugations.

Figure 3:
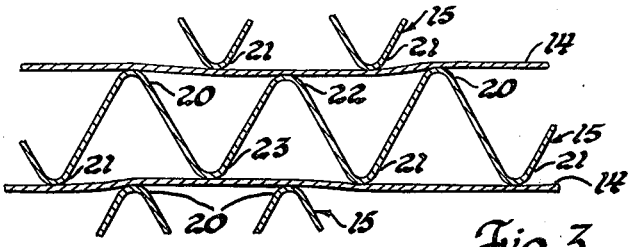
FIG. 3 is a view of a portion of the structure shown in FIG. 2 with the elements shown deflected under a radial load; and, FIG. 4 is a view showing the deeply corrugated strip of the matrix disk as formed from a flat strip of stock material.

However, under conditions of a radial load and/or circumferential load, limited movement both radial and circumferentially of the wraps of the strip 14 and of the corrugated strip 15 is permitted by the above described configuration of the corrugated strip 15. Thus, for example, as seen in FIG. 3, under radial load the wraps of strip 14 in the regions next adjacent to the undersized ridges 22 and hollows 23 are free to deflect radially into engagement with these ridges and hollows to prevent undue stressing of these strips. It will be apparent that under circumferential loading, limited circumferential movement of these elements is due to the clearance provided by the ridges 22 and hollows 23 which are not fixed to the adjacent sections of the strip 14, each corrugation formed by a ridge 22 and hollow 23 being thus yieldable circumferentially of the matrix.

The number of the undersized ridges 22 and hollows 23 and the spacing of these undersized ridges and hollows on the corrugated strip 15 can be selected, as desired. In other words, the number of ridges 20 and hollows 21 in a set of corrugations separated by a least one corrugation containing one undersized ridge 22 and undersized hollow 23 from the next set of corrugations containing the ridges 20 and hollows 21 can be selected as desired for a particular size matrix structure depending on its intended use, and of course this spacing can be varied in the spiral wraps as they extend radially outward from the hub 11. It should, however, be realized that each such undersized ridge 22 and hollow 23, since they are not fixed, as by brazing, to the adjacent wraps of strip 14, present a potential circumferential leakage path therebetween unless, under stress loading, these elements are in engagement with each other, as shown in FIG. 3. Accordingly, the number and spacing of these ridges 22 and hollows 23 should be selected so as to keep these potential circumferential leakage paths to a minimum but at the same time sufficient numbers of these should be provided to prevent the build-up of undesirable stresses in the matrix structure under either the radial load and/or circumferential load encountered during service of the matrix structure.

Although, in the embodiment shown in FIGS. 2 and 3, the corrugations of the corrugated strip 15, as provided by the ridges 20 and hollows 21 are shown as being of uniform depth and width, these corrugations and, of course, the corrugations provided by the undersized ridges 22 and hollows 23 can be varied, as desired, as by providing the corrugations next adjacent to the hub 11 with a substantially greater depth and less width than that of the corrugations next adjacent to the rim 16, as shown in FIG. 1.

It should also be realized that although, in the embodiment shown, the sheet 14 is illustrated as being a flat shim stock material, cooperating with a corrugated strip 15 constructed in accordance with the invention, the strip 14 could be a shallow corrugated spacer strip, such as disclosed in the previously identified U.S. Pat. No. 3,532,157.

What is claimed is:

1. A rotary regenerator matrix structure of annular form porous to flow of fluid generally parallel to the axis of the matrix, said matrix structure comprising first and second spiral wound strips with each turn of the first strip disposed between adjacent turns of the second strip and with said strips abutting face-to-face and fixed together into a rigid, elastic structure, said first strip having corrugations trending generally of the matrix, said corrugations including a repeatable series of a plurality of first corrugations each uniformly of substantial depth radially of the matrix and at least a second corrugation of reduced radial depth as compared to said first corrugations, said first corrugations of said first strip abutting at their radially extreme portions against adjacent turns of said second strip and being fixed thereto, the second corrugation being unsecured to the second strip to permit free spiral movement between the second corrugation and the second strip.

2. In a rotary regenerator matrix structure of annular form porous to flow of fluid generally parallel to the axis of the matrix, the matrix structure comprising first and second spiral wound strips with each turn of the first strip disposed between adjacent turns of the second strip and with the strips abutting face-to-face and fixed together into a rigid elastic structure, the first strip being formed with corrugations trending generally axially of the matrix and with substantial depth radially of the matrix to separate radially the turns of the second strip, the improvement wherein selected spaced apart corrugations of said first strip are of reduced amplitude as compared to the remaining corrugations of said first strip.

* * * * *